United States Patent [19]

Hansen et al.

[11] 4,170,219

[45] Oct. 9, 1979

[54] FIREPLACE

[76] Inventors: William A. Hansen, 95 Ashland Ave., Winnipeg, Manitoba; William A. Conly, 720 Vaughn Ave., Selkirk, Manitoba, both of Canada

[21] Appl. No.: 841,352

[22] Filed: Oct. 12, 1977

[30] Foreign Application Priority Data

May 6, 1977 [CA] Canada ..... 277887

[51] Int. Cl.[2] ..... F24B 1/18

[52] U.S. Cl. ..... 126/121

[58] Field of Search ..... 126/121, 122, 131, 61, 126/63, 66, 67; 237/51

[56] References Cited

U.S. PATENT DOCUMENTS

| | | | |
|---|---|---|---|
| 1,587,227 | 6/1926 | Hallberg | 126/121 |
| 1,588,587 | 6/1926 | Klaus | 126/121 |
| 3,888,231 | 6/1975 | Galluzzo et al. | 126/121 |
| 4,003,362 | 1/1977 | Lener | 126/121 |
| 4,010,728 | 3/1977 | Hempel et al. | 126/121 |
| 4,060,196 | 11/1977 | Goldsby et al. | 126/121 X |
| 4,074,679 | 2/1978 | Jensen | 126/121 |
| 4,089,320 | 5/1978 | Brown et al. | 126/121 |

FOREIGN PATENT DOCUMENTS

| | | | |
|---|---|---|---|
| 137766 | 6/1950 | Australia | 126/121 |
| 844348 | 8/1960 | United Kingdom | 126/121 |

*Primary Examiner*—William F. O'Dea
*Assistant Examiner*—Harold Joyce
*Attorney, Agent, or Firm*—Jerome P. Bloom

[57] ABSTRACT

The invention relates to a heater which is connected to the flue of a house. The heater includes a firebox, an intermediate plenum chamber and an outer plenum chamber. Either atmospheric or ambient air is introduced into the heater and led over the heated surfaces of the two plenum chambers before issuing into the space to be heated.

1 Claim, 2 Drawing Figures

FIREPLACE

The invention relates to a heater for circulating air. When considering home heating, and due to the extremely high cost of solid fuel, it is essential that the fireplace be efficient as possible.

Most open fireplaces are inefficient where 90% of the air travelling up the chimney is heated air from the house being forced into the flue by convection. The amount of air actually required for combustion is only a fraction of this total volume and such air must be replaced in the house, usually through the intermediary of windows, doors and electrical outlets. The usual open fireplace, in effect then, creates a vacuum in the house by forcing such a large amount of air up the chimney that the heating efficiency of such fireplaces is, to all intent and purpose, nil.

It is the object of the present invention, therefore, to provide a heater which will overcome the above disadvantages.

The invention is illustrated, by way of example, in the accompanying drawings in which.

Figure 1:
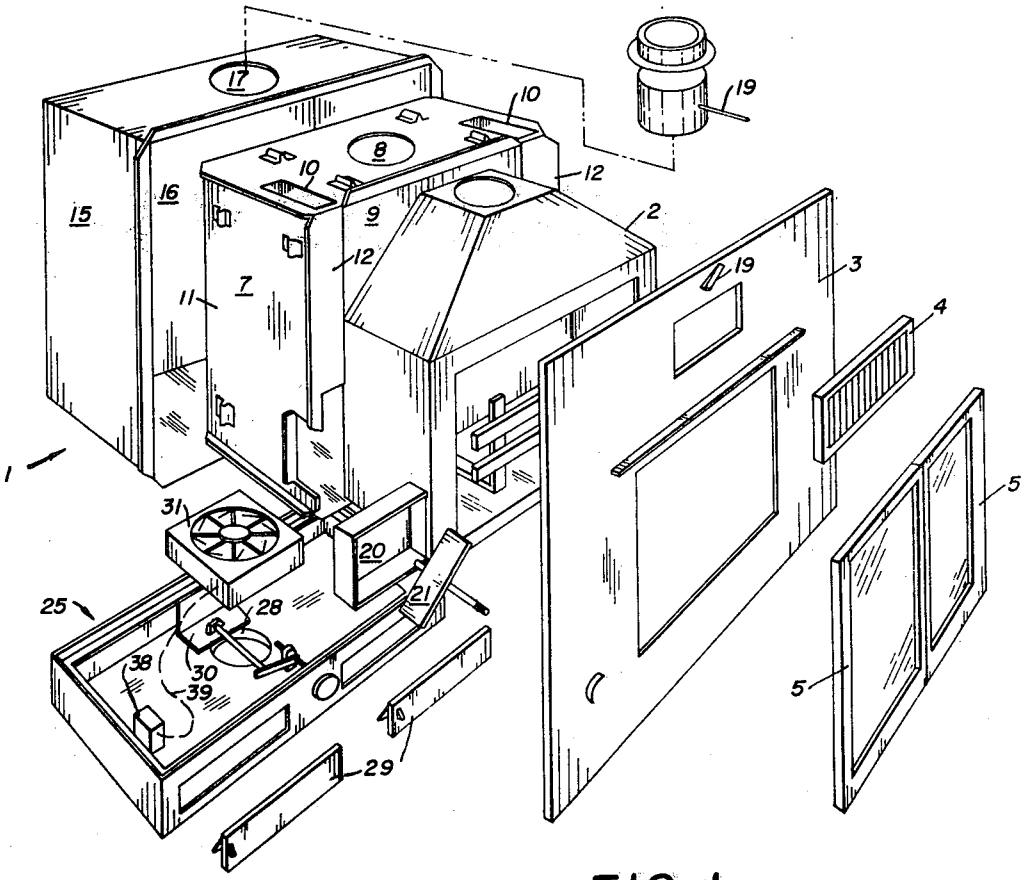
FIG. 1 is an exploded view of the heater.
Figure 2:
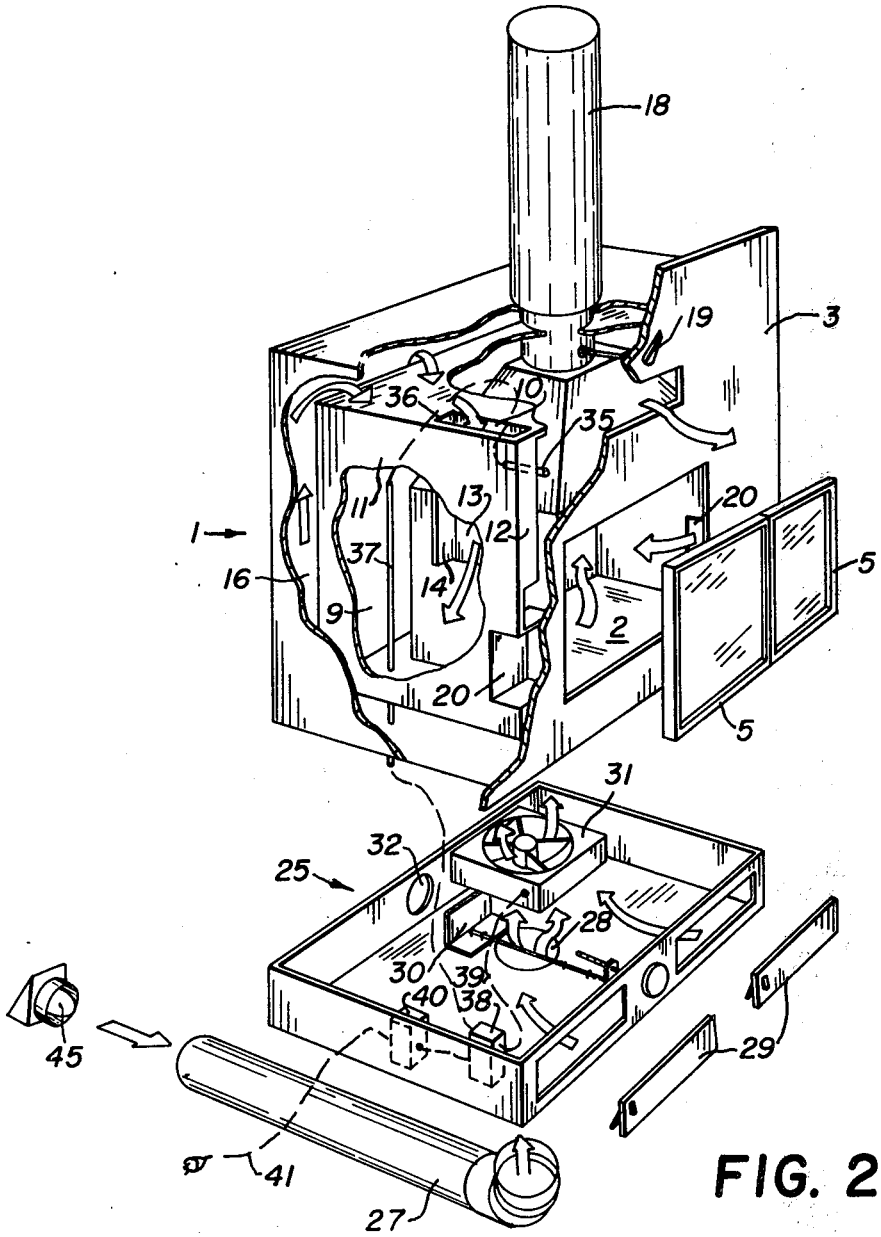
FIG. 2 is a similar view but with the heater partially assembled.

Referring to the drawings, the heater includes an upper portion indicated generally at 1 and a lower portion indicated generally at 25. The upper portion 1 includes a firebox 2, capable of receiving fuel, the front of which abuts a front plate 3 provided with a louvered vent 4 (not shown in FIG.2) and a pair of hinged tempered glass fronted doors 5. The upper part of the firebox 2 is frusto-pyramidal in cross-section and is provided with a smoke outlet 6.

The firebox 2 is disposed within, but spaced from, an intermediate housing 7 also provided with an orifice 8 with the space between said housing and the firebox defining a plenum chamber 9. A pair of primary flow chutes 10 is provided within the housing 7, each one of which is located adjacent a side wall 11 of said housing 7. Each chute is defined by a said side wall 11, a front wall 12, an inner wall 13 (See FIG. 2) and a rear baffle 14 (also shown in FIG. 2).

An outer housing 15 is also provided and this is disposed about, and spaced from, the intermediate housing 7 so as to define an outer plenum chamber 16 between this pair of housings. The outer housing 15 is also provided with an orifice 17 and a dampered smoke chimney 18, controlled by damper 19, passes through the orifices 17 and 8 as well as the smoke outlet 6 so as to connect the firebox 2 with the flue or chimney of the house. The outer housing 15 is also provided with an air inlet (not shown) in its bottom which inlet is in communication with the lower unit 25.

A pair of vents 20 also connect the outer plenum chamber 16 to the firebox 2, one on either side of the latter near the bottom front thereof, and these are each controlled by a damper 21.

The lower portion 25 of the heater includes an air chamber 26 located beneath the upper portion 1 and in communication with the outer plenum chamber as well as with atmospheric (or outside) air and ambient (or inside) air. The chamber 26 communicates with atmospheric air through the intermediary of duct 27 (FIG. 2) and a hole 28 in the bottom of portion 25 or hole 32 in the back of portion 25, (whichever is the most convenient, with the remaining hole being blanked off), and with ambient air through a pair of adjustable vents 29 located in the front of the lower portion 25. Hole 28 is provided with a damper 30. A fan 31 is also provided within the lower portion 25 and attached to the underside of plenum chamber 15.

A heat sensing bulb 35 (FIG. 2) located in the upper portion 1, is connected to a capillary tube 36, extending through a tubular guide 37, which is connected to a thermostat 38 located in the lower portion 25. Thermostat 38 is connected to fan 31 via an electric supply line 39 as well as to a junction box 40 and from the latter, via line 41, to any suitable source of electrical supply. The inlet end of duct 27 is provided with a hinged, weighted damper 45 to inhibit reverse air flow.

In operation, the upper and lower portions 1 and 25 of the heater are connected together to form one combined unit. After installation in a house and connection to the flue and when required for use, the operator opens the doors 5 and places any suitable solid fuel in the firebox and ignites it. Atmospheric air is then introduced into the lower portion 25 and air chamber 26 via tube 27 and fan 31. It will be appreciated that if and when the fan stops, the weighted damper 45 will automatically close so as to prevent reverse air flow. The fan 31 then forces the atmospheric air up into the outer plenum chamber 16 and up the back and two sides of the intermediate housing 7, then over the top of the latter and down the pair of chutes 10 and into the plenum chamber 9, with the baffles 14 assisting in directing such air downwardly. The air then rises and passes over the outer surfaces of the firebox 2 before passing out through the vent 4 to the area or interior of the room to be heated. Obviously, the air during its passage through the outer and inner plenum chambers, will be heated.

Air for combustion is introduced into the firebox 2 through the vents 20 and which because of the dampers 21, restrict air flow when required.

As will be appreciated, the doors 5 on the front of the heater must be sealed for the unit to operate efficiently. With these doors closed, air for combustion can be properly metered into the firebox 2 and all air passing through the heat exchange chambers will be atmospheric air or ambient air or a mixture of both. This is accomplished by adjusting damper 30 to partially or wholly close off the avenue of atmospheric air and simultaneously opening vents 29 to allow ambient air to enter the plenum chambers. This arrangement provides an extremely efficient means of completely closing off outside air and reheating the inside air only when the outside air is too extreme for efficient heat exchange. Moreover, upon retiring for the night, if only inside air is being circulated then, once the fire burns out, any air still circulating through the unit by simple convection will be heated inside air and not cold outside air. The thermostat, 38, of course, prevents cold air being drawn into the house when the fire dies out. Hence, the house will be pressurized by the action of the fan drawing air into the house from outside when the glass doors are shut. Additionally, only sufficient air will be permitted to enter the firebox to support combustion. The amount of hot gases escaping up the flue or chimney is only a small portion of that from an open fireplace.

On the other hand, if the doors are left open, the unit becomes a conventional inefficient fireplace or heatilator because the room air will just escape up the flue or chimney.

We claim:

1. A heater for circulating air and adapted to be disposed within a fireplace provided with a flue said heater comprising an upper portion and a lower portion:- the upper portion including:

(a) a firebox capable of receiving fuel, having a closable front opening and adapted to be connected to said flue;

(b) an intermediate housing disposed about, and spaced from, said firebox so as to define a plenum chamber intermediate said firebox and said housing;

(c) at least one primary flow chute within said housing adjacent one side thereof;

(d) an outer housing disposed about, and spaced from, said intermediate housing so as to define an outer plenum chamber between said pair of housings; and (e) at least one dampered vent leading from said outer plenum chamber to said firebox;

the lower portion including:

(f) an air chamber located beneath said upper portion and in communication with the outer plenum chamber as well as with atmospheric air and ambient air;

(g) damper means for regulating the amount of atmospheric air admitted to the air chamber;

(h) at least one adjustable vent for regulating the amount of ambient air admitted to the air chamber; and (i) a fan within the air chamber for forcing the air admitted thereto into the outer plenum chamber where a portion of the air is metered through said dampered vent to the firebox for combustion purposes and where the balance of said air is forced from said outer plenum chamber, through the chutes into the intermediate plenum chamber and from the latter over the heated surfaces of the firebox and from said heater to the area to be heated.

* * * * *